US009510702B2

(12) United States Patent
Yau

(10) Patent No.: US 9,510,702 B2
(45) Date of Patent: Dec. 6, 2016

(54) HANGER WITH SECURING PANELS

(71) Applicant: Wai Shing Yau, Hong Kong (HK)

(72) Inventor: Wai Shing Yau, Hong Kong (HK)

( * ) Notice: Subject to any disclaimer, the term of this patent is extended or adjusted under 35 U.S.C. 154(b) by 0 days.

(21) Appl. No.: 14/470,791

(22) Filed: Aug. 27, 2014

(65) Prior Publication Data

US 2015/0060500 A1 Mar. 5, 2015

Related U.S. Application Data

(60) Provisional application No. 61/872,253, filed on Aug. 30, 2013.

(51) Int. Cl.

| | |
|---|---|
| ***A41D 27/22*** | (2006.01) |
| ***A47G 25/14*** | (2006.01) |
| ***A47G 25/16*** | (2006.01) |
| ***A47G 25/48*** | (2006.01) |

(52) U.S. Cl.

CPC ..... *A47G 25/1435* (2013.01); *A47G 25/16* (2013.01); *A47G 25/482* (2013.01)

(58) Field of Classification Search

CPC ..... A47G 25/16; A47G 25/18; A47G 25/48; A47G 25/481; A47G 25/482; A47G 25/483; A47G 25/487

USPC ..... 223/91, 96

See application file for complete search history.

(56) References Cited

U.S. PATENT DOCUMENTS

| | | | | | |
|---|---|---|---|---|---|
| 3,047,196 | A | * | 7/1962 | Levine et al. | 223/96 |
| 3,165,245 | A | * | 1/1965 | Levine et al. | 223/91 |
| 3,502,251 | A | * | 3/1970 | Hart | 223/96 |
| D225,151 | S | * | 11/1972 | Hart | D6/326 |
| 3,744,685 | A | * | 7/1973 | Hart | 223/96 |
| 3,950,823 | A | * | 4/1976 | Schreter | 24/66.13 |
| D271,552 | S | * | 11/1983 | Samuels | D6/319 |
| 4,438,874 | A | * | 3/1984 | Zuckerman et al. | 223/88 |
| D296,847 | S | * | 7/1988 | Kawalek | D6/326 |
| 4,871,097 | A | * | 10/1989 | Blanchard et al. | 223/85 |
| 5,029,739 | A | * | 7/1991 | Blanchard et al. | 223/88 |
| 5,113,554 | A | * | 5/1992 | Gallo et al. | 24/545 |
| 5,967,388 | A | * | 10/1999 | Kolton et al. | 223/95 |
| 6,000,588 | A | * | 12/1999 | Kolton et al. | 223/88 |
| D506,077 | S | * | 6/2005 | Pluchino et al. | D6/326 |
| 7,757,909 | B2 | * | 7/2010 | Jones | 223/96 |
| 8,267,287 | B2 | * | 9/2012 | Gouldson | 223/88 |
| 2006/0011670 | A1 | * | 1/2006 | Pluchino et al. | 223/85 |

* cited by examiner

*Primary Examiner* — Nathan Durham

(74) *Attorney, Agent, or Firm* — Baker & McKenzie LLP

(57) ABSTRACT

The present disclosure relates, according to some embodiments, to articles and systems for hangers. In some embodiments, hangers may be operable as garment hangers. A hanger may comprise a body comprising two arms disposed opposite to each other, a neck disposed upward from the body, and an auxiliary section disposed downward from the body. The auxiliary section may comprise an auxiliary panel connected to the body by an extension panel, and at least one securing panel disposed on the auxiliary panel. The securing panel may comprise an outer tab connected to the auxiliary panel at two points, at least one vertical tab connected to the auxiliary panel between the two points, and at least one lateral tab disposed along an inner wall of the outer tab. Lateral tabs may comprise a rectangular, trapezoidal, or other polygonal geometry.

21 Claims, 6 Drawing Sheets

HANGER WITH SECURING PANELS

CROSS-REFERENCE TO RELATED APPLICATIONS

This application claims priority to U.S. Provisional Application No. 61/872,253 filed on Aug. 30, 2013. The entire contents of the application listed above are hereby incorporated in their entirety by reference.

FIELD OF THE DISCLOSURE

The present disclosure relates, in some embodiments, to hangers. More specifically, the present disclosure relates to garment hangers with auxiliary extensions.

SUMMARY

The present disclosure relates, according to some embodiments, to articles and systems for hangers. In some embodiments, hangers may be operable as garment hangers. A hanger may comprise a body comprising two arms disposed opposite to each other, a neck disposed upward from the body, and an auxiliary section disposed downward from the body. The auxiliary section may comprise an auxiliary panel connected to the body by an extension panel, and at least one securing panel disposed on the auxiliary panel. The securing panel may comprise an outer tab connected to the auxiliary panel at two points, at least one vertical tab connected to the auxiliary panel between the two points, and at least one lateral tab disposed along an inner wall of the outer tab.

In some embodiments, a hanger may comprise a body comprising two arms disposed opposite to each other, a neck disposed upward from the body, and at least one securing panel disposed on at least one of the two arms. The securing panel may comprise an outer tab connected to the body at two points, at least one vertical tab connected to the body between the two points, and at least one lateral tab disposed along an inner wall of the outer tab. In some embodiments, the hanger may further comprise an auxiliary section disposed downward from the body, the auxiliary section comprising an auxiliary panel connected to the body by an extension panel. At least one auxiliary or additional securing panel may be disposed on the auxiliary panel. The additional securing panel comprising an auxiliary or additional outer tab connected to the auxiliary panel at two points, at least one auxiliary or additional vertical tab connected to the auxiliary panel between the two points, and at least one auxiliary or additional lateral tab disposed along an inner wall of the outer tab.

Lateral tabs of the present disclosure may be disposed along opposing inner walls or opposing sides of an inner wall of the outer tab of the securing panel. In some embodiments, a hanger may comprise a pair of two lateral tabs, wherein each pair of two lateral tabs are disposed along opposing inner walls or opposing sides of an inner wall of the outer tab of the securing panel.

In some embodiments, lateral tabs may comprise a rectangular, trapezoidal, or other polygonal geometry. In some embodiments, lateral tabs may comprise a length of about 0.1 mm to about 40 mm. In some embodiments, lateral tabs may comprise a width of about 0.1 mm to about 15 mm. In some embodiments, lateral tabs may comprise a thickness of about 0.1 mm to about 10 mm.

BRIEF DESCRIPTION OF THE DRAWINGS

Some embodiments of the disclosure may be understood by referring, in part, to the present disclosure and the accompanying drawings, wherein.

DETAILED DESCRIPTION

The present disclosure relates, according to some embodiments, to articles, systems, and methods of use for hangers. More specifically, hangers of the present disclosure may be operable as garment hangers. In some embodiments, hangers of the present disclosure may comprise various features and/or components such as auxiliary extensions, securing panels, downward tabs, and lateral tabs. The aforementioned components may advantageously promote the securing of a garment on or against the hanger. Various features and benefits provided by the present disclosure may be best understood by one of ordinary skill in the art by reference to the accompanying figures and the description herein.

Figure 1C:
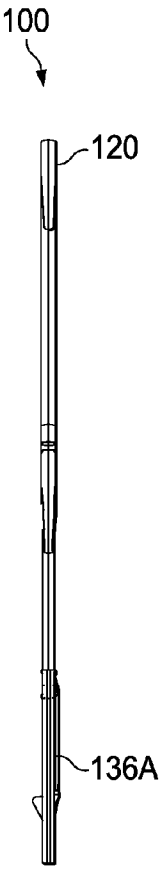
FIG. 1C illustrates a right side view of a hanger according to one embodiment of the present disclosure.
Figure 1B:
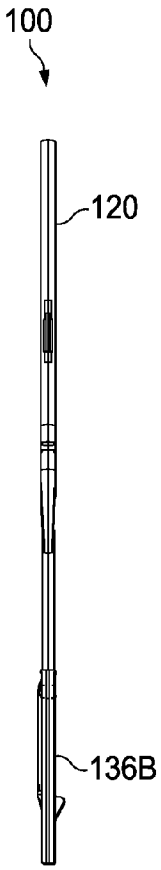
FIG. 1B illustrates a left side view of a hanger according to one embodiment of the present disclosure.
Figure 1A:
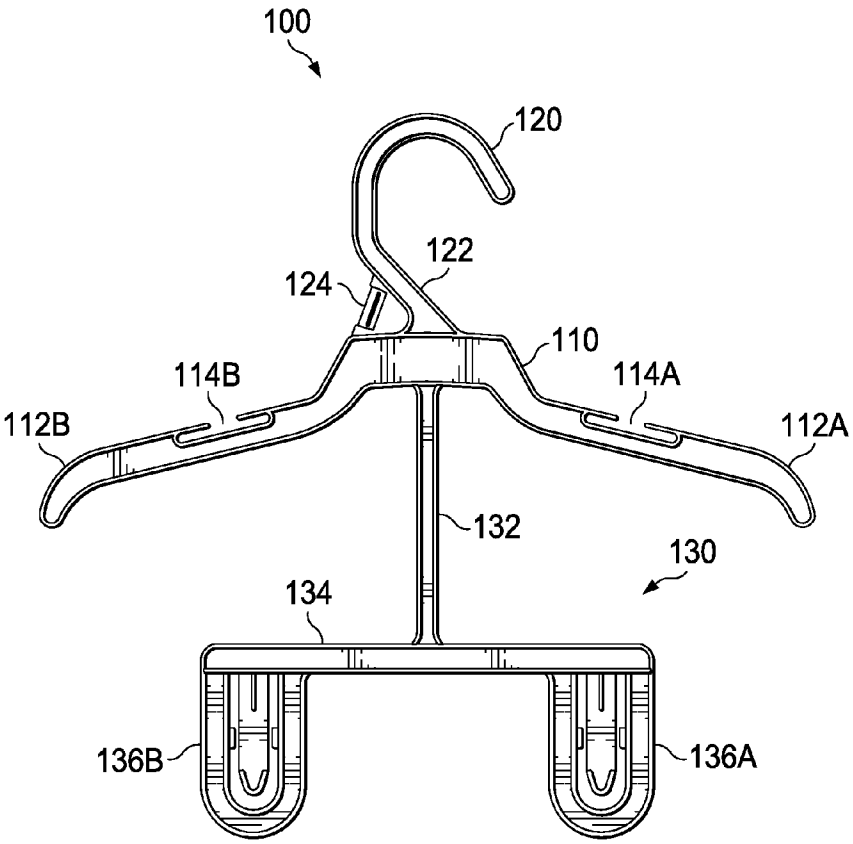
FIG. 1A illustrates a front view of a hanger according to one embodiment of the present disclosure.
Figure 1D:
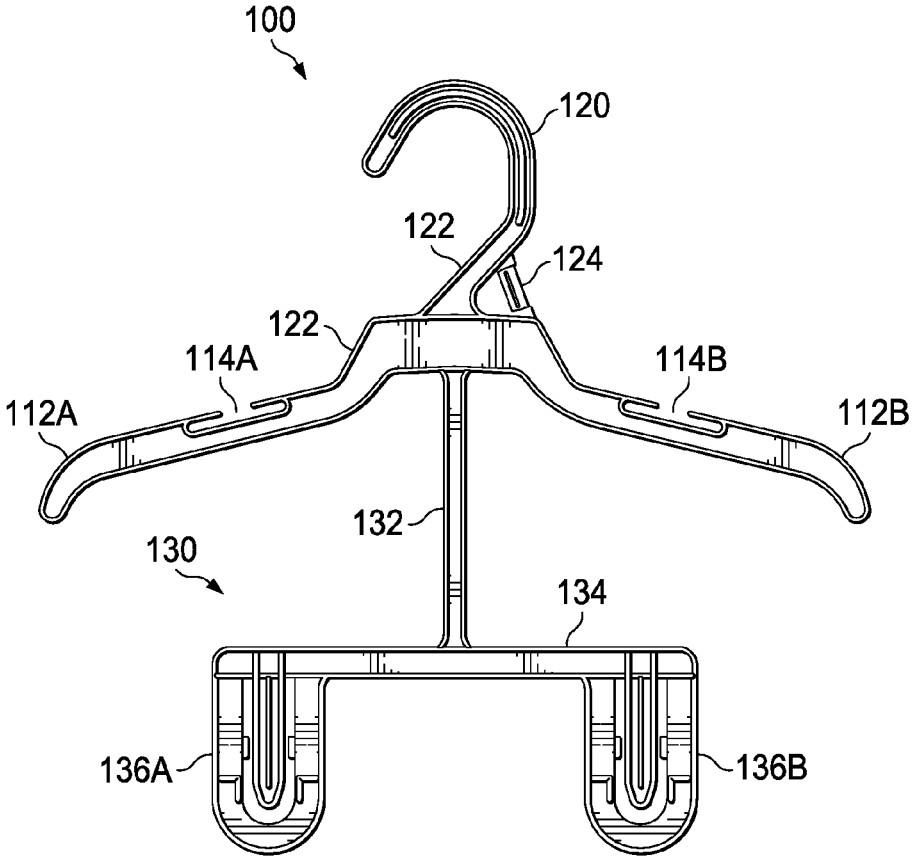
FIG. 1D illustrates a back view of a hanger according to one embodiment of the present disclosure.
Figure 1E:
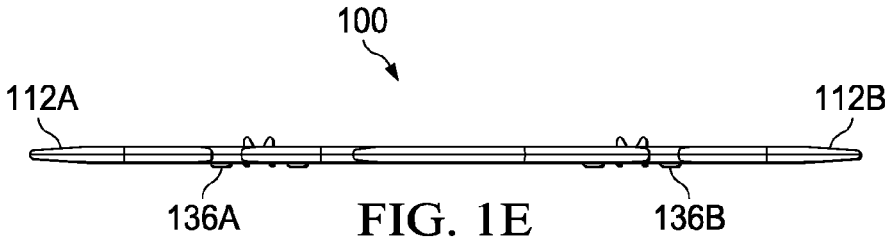
FIG. 1E illustrates a top view of a hanger according to one embodiment of the present disclosure.
Figure 1F:
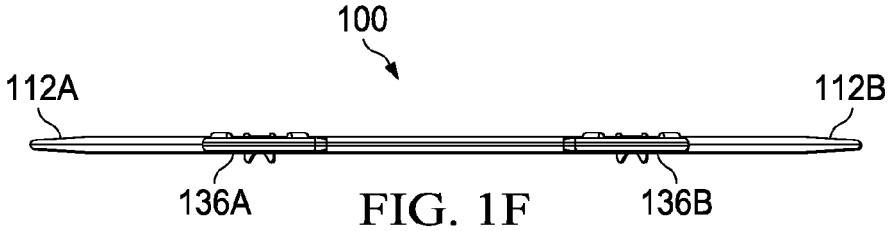
FIG. 1F illustrates a bottom view of a hanger according to one embodiment of the present disclosure.

FIGS. 1A-1F show example embodiments of a hanger 100 from various perspectives. As shown in FIG. 1A, the hanger 100 may comprise a body 110, a neck 120, and an auxiliary section 130. The body 110 may comprise two arms 112A, 112B disposed opposite to one another. The arms 112A, 112B may or may not have an angle of inclination with respect to a horizontal or lateral axis of the hanger. As shown in FIG. 1A and FIG. 1D, arms 112A, 112B may have a slight downward angle of inclination with respect to a horizontal or lateral axis of the hanger. A recess 114A, 114B may be disposed on each of the arms 112A, 112B of the body 110. The recess 114A, 114B may advantageously help to secure a garment therein or against the body 110 of the hanger 100.

The neck 120 may be disposed upward from the body. As used herein, the directions of upward and downward may be understood as referring to the directions with respect to the usual orientation of use for a hanger. The upward direction may be closer to the neck 120, where as the body 110 may be considered as being disposed downward from the neck 120.

The neck 120 may be a hook or a hook-like structure. The neck 120 may be disposed at the top of the hanger 100 and may vary in design without departing from the description herein. In some embodiments, the neck 120 may comprise a base 122. In some embodiments, the base 122 and/or neck 120 may be monolithic with the body 110. In some embodiments, the base 122 and/or neck 120 may be a separate component that may be secured to the body 110. For example, the hanger 100 may comprise a snap-on feature or a clip-feature to secure the base 122 and/or neck 120 to the body 110.

The base 122 may comprise a particular geometry. In some embodiments, geometries of the base 122 may comprise substantially rectangular geometries, substantially triangular geometries, substantially trapezoidal geometries, substantially semi-circular geometries, or any variation thereof.

The base may comprise a tab 124. The tab 124 may be a releasable information tab 124. Described further, the releasable information tab 124 may allow a tab or a marker to be secured therein. For example, a price tag or a category marker may be secured therein to advantageously promote organization of or provide information regarding various garments secured on a plurality of hangers 100. Such description is provided by way of example only and is not intended to be limiting.

As shown in FIG. 1A-1F, hanger 100 of the present disclosure may advantageously provide for an auxiliary section 130. In some embodiments, the auxiliary section 130 may be a separate section secured to the body 110. For example, the hanger 100 may comprise a snap-on feature or a clip-feature to secure the auxiliary section 130 to the body 110. In some embodiments, the auxiliary section 130 may be monolithic with the body 110.

The auxiliary section 130 may be disposed downward from the body 110. The auxiliary section may comprise an extension panel 132 and an auxiliary panel 134. The extension panel 132 may be a substantially rectangle component designed to secure the auxiliary panel 134 to the body 110. Additionally or alternatively, the extension panel 132 may advantageously allow another component, such as the auxiliary panel 134 to be disposed at a lower position on the hanger 100 than the body 110.

The auxiliary panel 134 may be disposed downward from the extension panel 132 and the body 110. As shown in FIG. 1A-1F, at least one securing panel 136A, 136B may be disposed on the auxiliary panel 134. As shown in FIG. 1A-1F, example embodiments of the present disclosure may comprise two securing panels 136A, 136B disposed on the auxiliary panel 134. However, any number or plurality of securing panels 136A, 136B may be disposed on the auxiliary panel 134 without departing from the present disclosure. In some embodiments, additional securing panels 136A, 136B may advantageously promote better securing of a garment against the hanger 100.

Figure 2:
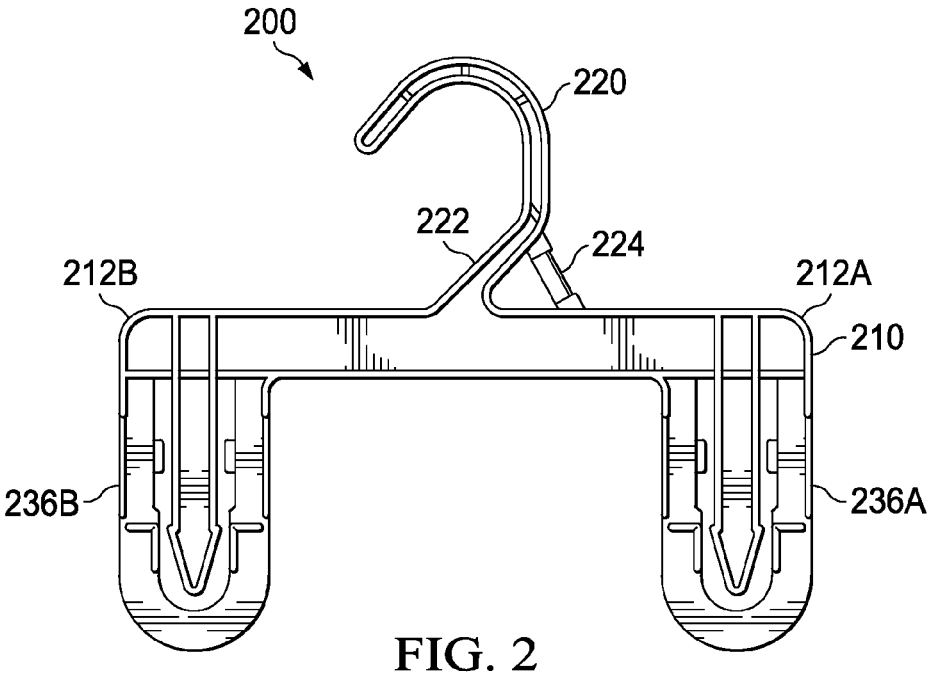
FIG. 2 illustrates a front view of a hanger according to one embodiment of the present disclosure.

FIG. 2 shows an alternative embodiment of a hanger 200 according to the present disclosure. As shown, the hanger 200 may also comprise a neck 220. The neck 220 may also comprise a base 222 and a tab 224. As shown, the base 222 may comprise a substantially triangular geometry. A tab 224 may be disposed on the base 222 of the neck 220 of the hanger 200. The hanger 200 may further comprise a body 210, wherein the body 210 may comprise two arms 212A, 212B disposed opposite to one another. The arms 212A, 212B may or may not have an angle of inclination with respect to a horizontal or lateral axis of the hanger.

As shown in FIG. 2, a plurality of securing panels 236A, 236B may be disposed directly on the body 210. Thus, as shown in FIG. 2, an extension panel and/or an auxiliary panel may not be needed to make use of the securing panels 236A, 236B of the present disclosure. Any of the aforementioned features and variations described for FIGS. 1A-1F may be incorporated in the embodiment of FIG. 2 without departing from the present disclosure.

Figure 3:
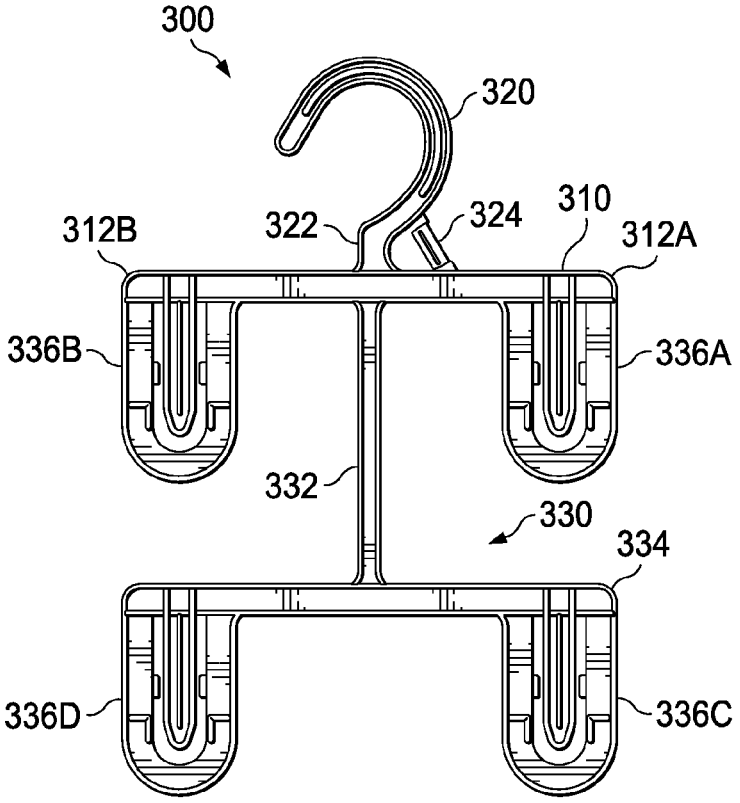
FIG. 3 illustrates a front view of a hanger according to one embodiment of the present disclosure.

FIG. 3 shows an alternative embodiment of a hanger 300 according to the present disclosure. As shown, the hanger 300 may also comprise a neck 320. The neck 320 may also comprise a base 322 and a tab 324. The hanger 300 may further comprise a body 310, wherein the body 310 may comprise two arms 312A, 312B disposed opposite to one another. The hanger 300 may further comprise an auxiliary section 330, which may be disposed downward from the body 310. The auxiliary section 330 may comprise an extension panel 332 and an auxiliary panel 334. The extension panel 332 may be a substantially rectangle component designed to secure the auxiliary panel 334 to the body 310, and to dispose the auxiliary panel 334 at a lower position than the body 310.

As shown in FIG. 3, a plurality of securing panels 336A, 336B, 336C, 336D may be disposed on the hanger 300. As shown, two securing panels 336A, 336B may be disposed on each arm 312A, 312B of the body 310. Further, two securing panels 336C, 336D may also be disposed at opposing ends of the auxiliary panels 334 of the auxiliary section 330. In such arrangement, embodiments of the present disclosure may advantageously provide for a plurality of securing panels 336A, 336B, 336C, 336D at upper and lower positions on the hanger 300. Such arrangement may advantageously provide for a more stable securing of a garment to the hanger 300. Alternatively or additionally, such arrangement may advantageously allow for more pieces of garments to be secured onto the hanger 300. Four securing panels 336A, 336B, 336C, 336D are illustrated in FIG. 3 by way of example only. A greater or fewer number of securing panels 336A, 336B, 336C, 336D may be disposed on the hanger 300 to achieve a number of goals or design considerations. Further, any of the aforementioned features and variations described for FIGS. 1-6 may be incorporated in the embodiment of FIG. 7 without departing from the present disclosure.

As shown in FIGS. 1A-1F, FIG. 2, and FIG. 3, embodiments of the present disclosure may comprise securing panels 136A, 136B, 236A, 236B, 336A, 336B, 336C, 336D. FIGS. 4A-4E illustrate close-up views of securing panels according to various embodiments of the present disclosure.

As shown in FIG. 4A-4E, securing panels 436 may be secured to or may be disposed on another segment of the hanger 400. Such segment may include, but is not limited to, the arms of the body or an auxiliary section. The securing tab 436 may comprise an outer tab 440. The outer tab 440 may be connected to the rest of the hanger 400 at two points. For example, the out tab 440 may be connected to an auxiliary panel at two points 442A, 442B. Upper ends of said geometries of the outer panels 440 may be attached to or otherwise adhered to the hanger 400 at two points of contact 442A, 442B. A lower end 444 of the outer panel 440 may comprise a particular geometry. In some embodiments, the lower end 444 of the outer panel 440 may comprise a substantially curved or semi-circular geometry. In some embodiments, the lower end 444 of the outer panel 440 may comprise substantially polygonal geometries. The outer tab 440 may have a substantially U-shaped or horseshoe shaped geometry.

In some embodiments, an outer panel 440 may comprise an inner wall 446. The inner wall 446 may comprise a substantially U-shaped or horseshoe shaped geometry. The inner wall 446 may have two flat, opposingly disposed sections. The two flat, opposing disposed sections may run parallel to a vertical axis of the hanger 400, wherein the vertical axis may be defined by the normal use of a hanger.

As shown in FIG. 4A-4E, securing tab 436 may comprise a vertical tab 450. A vertical tab 450 may be connected to the hanger 400, such as the auxiliary panel of a hanger 400, at an upper connection point 452. The connection point 452 may be between the two points of contact 442A, 442B of the outer panel 440. The connection point 452 may be at an upper portion of the vertical tab 450 and may provide a downward orientation of the vertical tab 450. The downward vertical tab 450 may comprise particular geometries. In some embodiments, the vertical tab 450 may comprise rectangular, triangular, or other appropriate geometries. A lower end 454 of the vertical tab 450 may comprise particular geometries. In some embodiments, the lower end 454 of the vertical tab 450 may comprise substantially triangular, arrow-like, or other appropriate geometries. In some embodiments, the vertical tab 450 may comprise a substantially arrow-shaped geometry.

A spacing 460 may be formed between the outer panel 440 and the vertical tab 450. The spacing 460 may have a U-shaped geometry. The spacing 460 may provide an opening or recess wherein a garment may be received or secured therein. A garment may bias against the structure of the outer panel 440 and the vertical tab 450 and thereby remain secured or remain in place. Described further, the securing panels 436 may be operable as clips, or may be operable to secure garments disposed therein. For example, in some embodiments, an article of clothing may be disposed under the vertical tab 450 and above the outer panel 440. In some embodiments, an article of clothing may be disposed above the vertical tab 450 and under the outer panel 440.

As shown in FIG. 4A-4E, securing panels 436 may further comprise lateral tabs 470A, 470B. In some embodiments, lateral tabs 470A, 470B may be disposed on an outer panel 440 and may be disposed inwardly towards the internal spacing 460. In such manner, the lateral tabs 470A, 470B may serve to narrow the spacing 460 between the outer panel 440 and the vertical tab 450. A narrowed spacing 460 in certain areas may advantageously allow for a garment to be more securely disposed on the hanger 400.

Hangers 400 of the present disclosure may comprise a plurality of lateral tabs 470A, 470B. In some embodiments, lateral tabs 470A, 470B may be disposed on the inner wall 446 of the outer pane 440, wherein the inner wall 446 may be adjacent to the internal spacing 460.

Figure 4A:
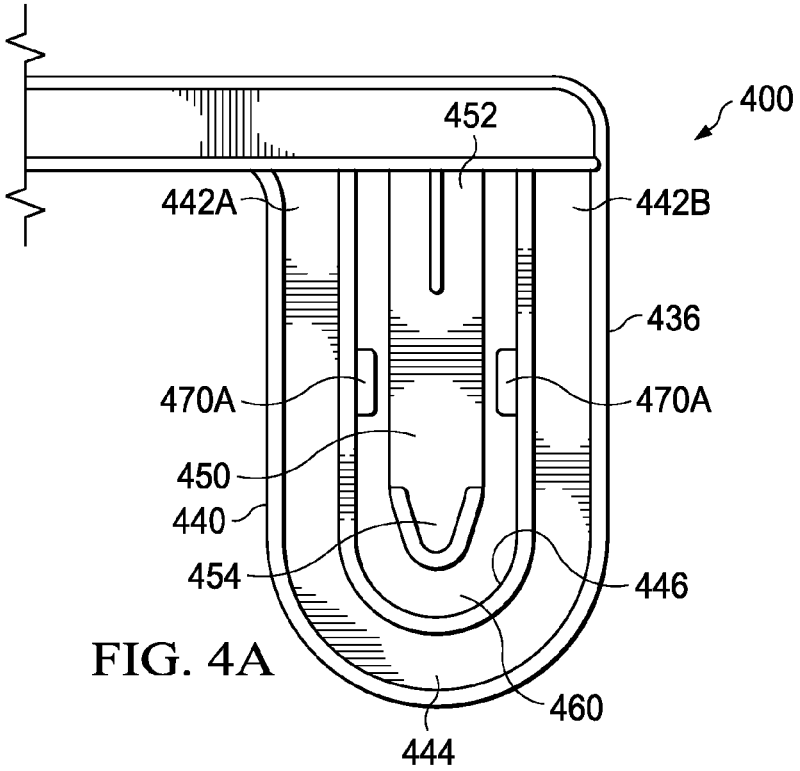
FIG. 4A illustrates a close-up view of a portion of a hanger according to one embodiment of the present disclosure.
Figure 4B:
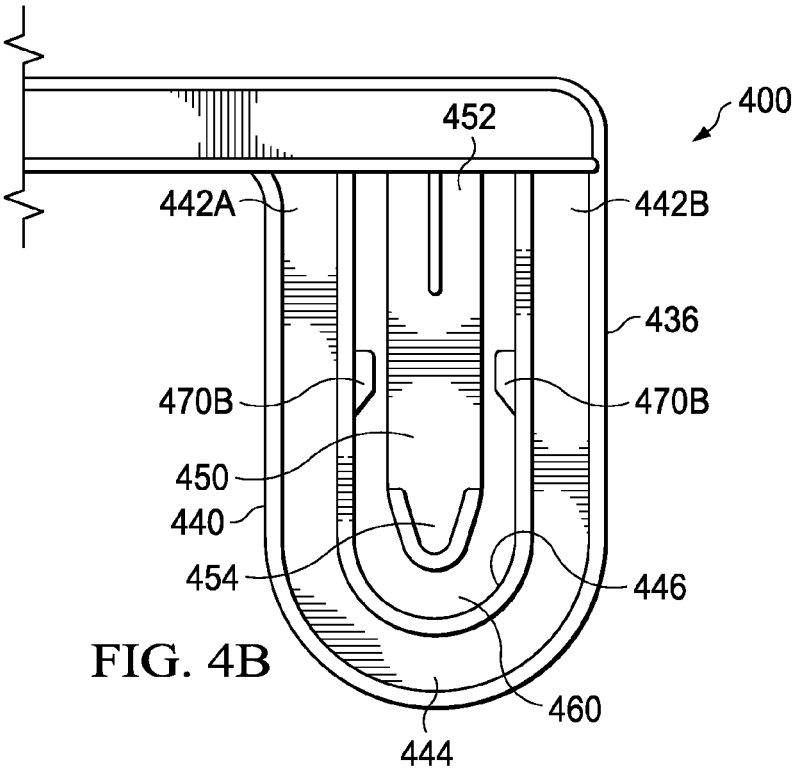
FIG. 4B illustrates a close-up view of a portion of a hanger according to one embodiment of the present disclosure.
Figure 4C:
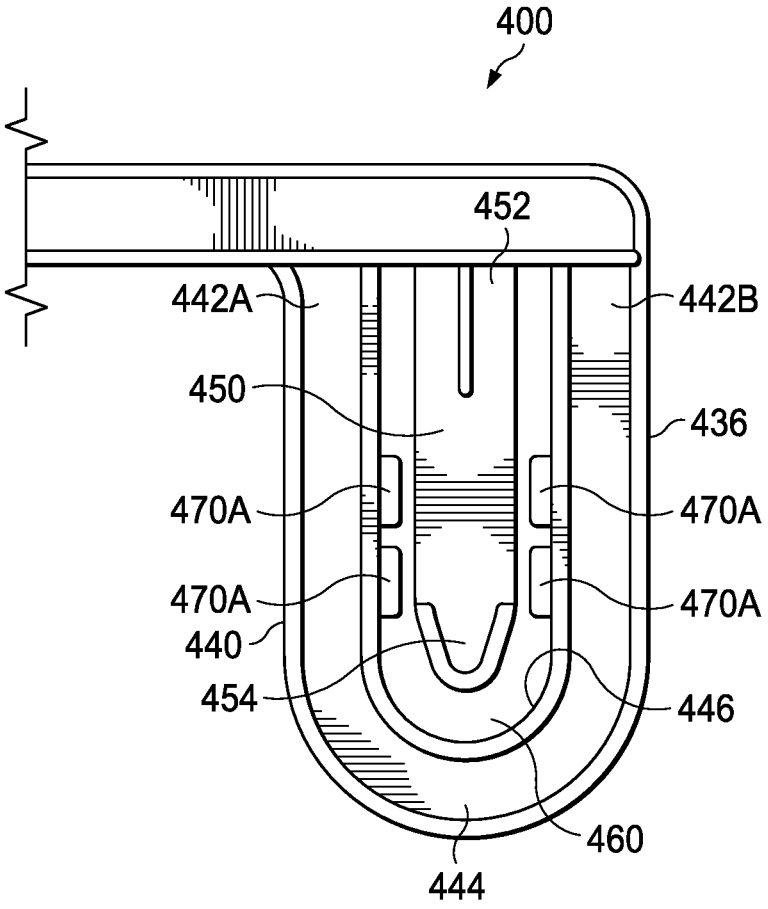
FIG. 4C illustrates a close-up view of a portion of a hanger according to one embodiment of the present disclosure.
Figure 4D:
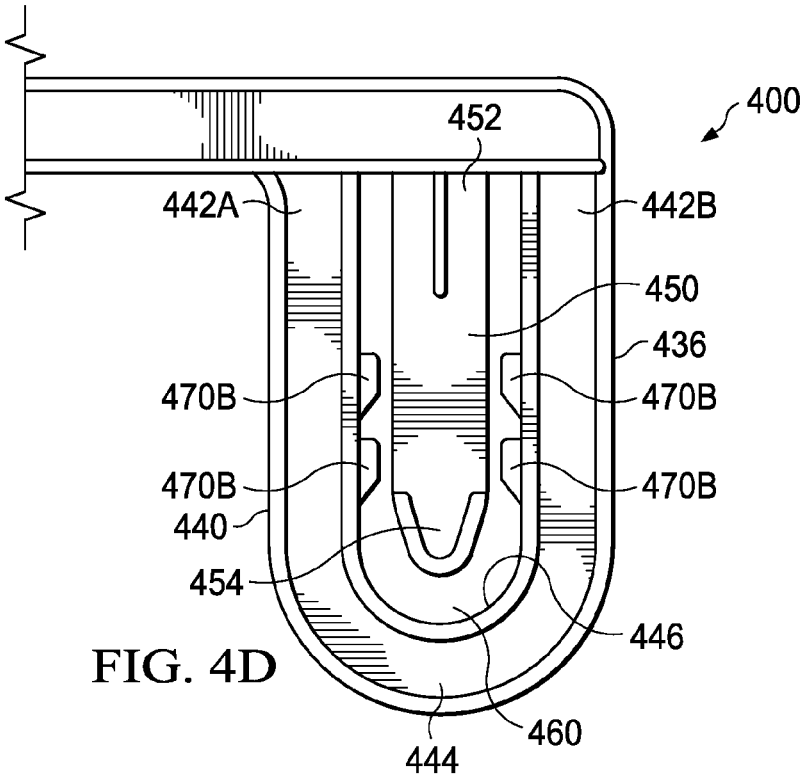
FIG. 4D illustrates a close-up view of a portion of a hanger according to one embodiment of the present disclosure.
Figure 4E:
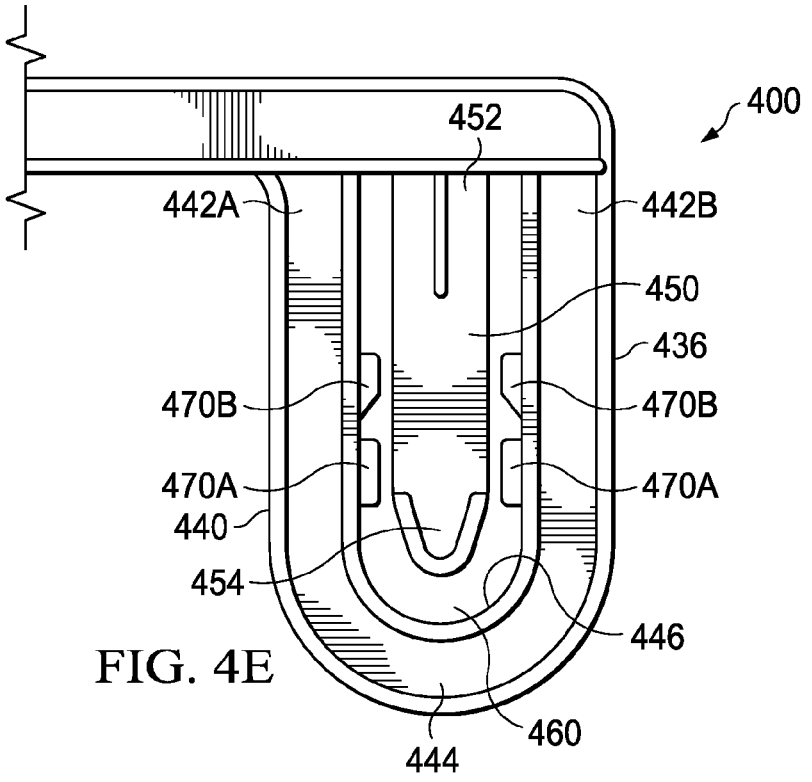
FIG. 4E illustrates a close-up view of a portion of a hanger according to one embodiment of the present disclosure.

The geometries of the lateral tabs 470A, 470B may be varied without departing from the scope of the present disclosure. For example, a rectangular lateral tab 470A may be used. As another example, a trapezoidal lateral tab 470B may be used. For example, as shown in FIG. 4A, the securing panel 436 may comprise two rectangular lateral tabs 470A. As shown in FIG. 4B, the securing panel 436 may comprise two trapezoidal lateral tabs 470B. As shown in FIG. 4C, the securing panel 436 may comprise four rectangular lateral tabs 470A. As shown in FIG. 4D, the securing panel 436 may comprise four trapezoidal lateral tabs 470B. As shown in FIG. 4E, the securing panel 436 may comprise a combination of lateral tabs 470A, 470B, such as two rectangular lateral tabs 470A and two trapezoidal lateral tabs 470B. Various geometries may be mixed and matched as needed or desired by a practitioner to achieve various design or functional goals.

Other suitable geometries may include, but are not limited to triangular, semi-circular, or other polygonal geometries. The geometries of lateral tabs 470A, 470B may advantageously allow a hanger 400 to more securely hold different types of articles of clothing or garments. Lateral tabs 470A, 470B having particular geometries may advantageously allow a hanger 400 to hold articles of clothing or garments without forming wrinkles thereon. Various geometries may be used for the lateral tabs without departing from the scope of the present disclosure.

The number of lateral tabs 470A, 470B used may be varied to achieve a number of functional objectives. For example, in FIG. 4A and FIG. 4B, two lateral tabs 470A, 470B are disposed on each of the securing panels 436. More specifically, one lateral tab 470A, 470B may be disposed along opposing inner walls 446 of the securing panel 436. Thus, each "side" of the inner wall 446 would comprise one lateral tab 470A, 470B disposed thereon. If the hanger 400 had two securing panels 436 (as shown in FIGS. 1A-1F and FIG. 2), then the hanger 400 may have a total of four lateral tabs 470A, 470B. As another example, in FIG. 4C, FIG. 4D, FIG. 4E, four lateral tabs 470A, 470B are disposed on each of the securing panels 436. More specifically, a pair of two lateral tabs 470A, 470B may be disposed wherein each pair of two lateral tabs 470A, 470B may be disposed along opposing or opposite sides of the inner wall 446 of the outer tab 440 of the securing panel 436. Each "side" of the inner wall 446 may comprise two lateral tabs 470A, 470B disposed thereon. If the hanger 400 has two securing panels 436 (as shown in FIGS. 1A-1F and FIG. 2), then the hanger 400 may have a total of eight lateral tabs 470A, 470B.

The aforementioned embodiments are provided by way of example only. Any number of lateral tabs 470A, 470B may be disposed on the securing panel 436. For example, a securing panel 436 may comprise six lateral tabs 470A, 470B, with three on each opposing side of the inner wall 446. As another example, a securing panel 436 may comprise five lateral tabs 470A, 470B, with two on one side and three on one side of opposing sides of the inner wall 446. Such variations made be made without departing from the scope of the present disclosure.

Any of the securing panels 436 illustrated in FIGS. 4A-4E may be incorporated or used in conjunction with the example embodiments shown in FIGS. 1A-1F, FIG. 2, and FIG. 3. Explained further, the securing panels 136A, 136B, 236A, 236B, 336A, 336B, 336C, 336D shown in FIGS. 1A-1F, FIG. 2, and FIG. 3 may include the features, such as the lateral tab designs, of any of FIGS. 4A-4E. Furthermore, the securing panels 436 illustrated in FIGS. 4A-4E are provided by way of example only. Design changes may be made without departing from the scope of the present disclosure.

Referring to FIG. 1B, FIG. 1C, FIG. 1E, and FIG. 1F, hanger 100 may have a relatively thin or flat profile or thickness. The thin profile may also apply to the securing panels 136A, 136B and any components and features thereof. For example, any outer panel 440, vertical tab 450, and lateral tabs 470A, 470B (as shown in FIGS. 4A-4F) may also have a relatively thin or flat profile or thickness.

Features and components of the present disclosure may have various sizes and dimensions. For example, sizes and dimensions of lateral tabs 470A, 470B may be varied to achieve a variety of aesthetical or functional objectives. In some embodiments, lateral tabs 470A, 470B may have a length or a longer dimension of about 0.1 mm to about 40 mm. In some embodiments, lateral tabs 470A, 470B may have a length or a longer dimension of about 5 mm to about 30 mm. In some embodiments, lateral tabs 470A, 470B may have a width or a shorter dimension of about 0.1 mm to about 15 mm. In some embodiments, lateral tabs 470A, 470B may have a width or a shorter dimension of about 2.5 mm to about 10 mm. In some embodiments, lateral tabs 470A, 470B may have a depth or a thickness of about 0.1 mm to about 10 mm. In some embodiments, lateral tabs 470A, 470B may have a depth or a thickness of about 1 mm to about 5 mm. Relevant dimensions may vary depending on the geometries chosen for particular lateral tabs. Dimensions of the lateral tabs may be varied without departing from the description herein.

In the present disclosure, hangers may comprise various materials. Such materials may include, but are not limited to metals, plastics, wood, wires, rubber, other suitable materials, and any combination thereof. In some embodiments, materials chosen for the securing panels may allow for particular degrees of pliancy or flexibility relative to the rest of the hanger. Pliancy or flexibility of the securing panels may advantageously allow for greater tease in securing a garment within or on the securing panel.

The present disclosure relates, according to some embodiments, to methods of use for hangers. In some embodiments, methods may comprise hanging or otherwise securing articles of clothing or garments to the hangers described in the present disclosure. In some embodiments, methods may comprise using at least one lateral tab to secure articles of clothing or garments to the hangers.

In some embodiments, an article of clothing disposed within the internal spacing 460 may be more securely held in place by at least one lateral tab 470A, 470B. A lateral tab 470A, 470B may be operable to grip or clasp an article of clothing against the vertical tab 450, an outer panel 440, or both. In some embodiments, a plurality of lateral tabs 470A, 470B may be disposed within one hanger. In some embodiments, a plurality of tabs 470A, 470B may be disposed on opposing sections of the inner wall 446 of the outer panel 440. Disposing lateral tabs 470A, 470B on opposing sides of the inner wall 446 may advantageously provide for greater security of the article of clothing or garment. Explained further, if the article of clothing or garment slips or otherwise becomes unsecured to one lateral tab 470A, 470B, a second lateral tab 470A, 470B may still provide the desired gripping effect or security. For example, if an article of clothing slips from an upper tab, a lower tab may still serve to secure the article of clothing to an attachment section of a hanger.

As will be understood by those skilled in the art who have the benefit of the instant disclosure, other equivalent or alternative compositions, devices, methods, and systems for hangers can be envisioned without departing from the description contained herein. Accordingly, the manner of carrying out the disclosure as shown and described is to be construed as illustrative only.

Persons skilled in the art may make various changes in the shape, size, number, and/or arrangement of parts without departing from the scope of the instant disclosure. For example, the position and number of lateral tabs may be varied. In addition, the size of a hanger may be scaled up (e.g., to be used for adult articles of clothing or garments) or down (e.g., to be used for juvenile articles of clothing or garments) to suit the needs and/or desires of a practitioner. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes to the disclosed articles, systems, methods for use, without departing from the description herein.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/− about 10%, depicted value +/− about 50%, depicted value +/− about 100%) and/or a range endpoint. With respect to the former, a value of 50 depicted in an example, table, and/or drawing may form the basis of a range of, for example, about 45 to about 55, about 25 to about 100, and/or about 0 to about 100.

All or a portion of an article and/or system for hangers may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

The invention claimed is:

1. A hanger comprising:

a body comprising two arms disposed opposite to each other;

a neck disposed upward from the body; and an auxiliary section disposed downward from the body, the auxiliary section comprising:

an extension panel extending downward from the body;

an auxiliary panel disposed downward from the extension panel; and at least one securing panel disposed on the auxiliary panel, each securing panel comprising:

an outer tab connected to the auxiliary panel at two points, the outer tab comprising a front face and a back face and having at least one cornered rib disposed on one of the front face and the back face of the outer tab, the at least one cornered rib comprising a first wall extending in a first direction intersecting a second wall extending in a second direction, both the first wall and the second wall being disposed on one of the front face and the back face of the outer tab;

at least one inner tab connected to the auxiliary panel between the two points, the at least one inner tab being substantially in the same vertical plane as the outer tab, the inner tab comprising a front face facing the same direction as the front face of the outer tab and a back face facing the same direction as the back face of the outer tab, the inner tab being dimensioned as to define a space between an inner perimeter of the outer tab and an outer perimeter of the inner tab in which at least one article of clothing can be captured, the inner tab further comprising a cornered rib disposed on an opposite face of the inner tab relative to each cornered rib of the outer tab, whereby the cornered ribs on the opposite faces of the outer and inner tabs comprise opposite ribs operable to capture an article of clothing positioned in the space defined between the outer and inner tabs; and at least one lateral tab disposed within the space defined between the inner tab and the outer tab, wherein each lateral tab comprises a top edge operable to capture the same or another article of clothing captured in the space defined between the outer and inner tabs, wherein the top edge is situated above the at least one cornered rib of the outer tab, and wherein the top edge of the lateral tab is a horizontal surface substantially perpendicular to a vertical axis of the inner tab.

2. The hanger of claim 1, wherein each of the at least one lateral tab is situated entirely above the at least one cornered rib of the outer tab, and wherein no lateral tab is situated below the at least one cornered rib of the outer tab.

3. The hanger of claim 2, wherein the inner tab comprises a rectangular section and a lower end below the rectangular section, wherein the cornered rib is disposed on the lower end of the inner tab, and wherein no part of the lower end of the inner tab is wider than the rectangular section of the inner tab.

4. The hanger of claim 1, wherein the at least one lateral tab comprises a rectangular, polygonal, or trapezoidal geometry that narrows part of the space defined between the outer tab and the inner tab.

5. The hanger of claim 1, wherein the cornered rib of the inner tab comprises an oval or semi-circular profile with at least one rugged corner, and wherein at least one cornered rib of the outer tab comprises an uppercase "L"-like shape.

6. The hanger of claim 1, wherein the inner perimeter of the outer tab comprises two flat, opposingly disposed sections running parallel to a vertical axis of the hanger, and wherein the lateral tab comprises a length of about 0.1 millimeter (mm) to about 40 mm.

7. The hanger of claim 1, wherein the lateral tab comprises a width of about 0.1 millimeter (mm) to about 15 mm.

8. The hanger of claim 1, wherein the lateral tab comprises a thickness of about 0.1 millimeter (mm) to about 10 mm.

9. The hanger of claim 1, wherein the securing panel comprises a pair of two lateral tabs, and wherein each pair of two lateral tabs are disposed along opposing sections of the inner perimeter of the outer tab of the securing panel.

10. A hanger comprising:

a body comprising two arms disposed opposite to each other;

a neck disposed upward from the body; and a securing panel disposed on at least one of the two arms, the securing panel comprising:

an outer tab connected to the body at two points, the outer tab comprising a front face and a back face and having at least one cornered rib disposed on one of the front face and the back face of the outer tab, the at least one cornered rib comprising a first wall extending in a first direction intersecting a second wall extending in a second direction, both the first wall and the second wall being disposed on one of the front face and the back face of the outer tab;

at least one inner tab connected to the body between the two points, the at least one inner tab being substantially in the same vertical plane as the outer tab, the inner tab comprising a front face facing the same direction as the front face of the outer tab and a back face facing the same direction as the back face of the outer tab, the inner tab being dimensioned as to define a space between an inner perimeter of the outer tab and an outer perimeter of the inner tab in which at least one article of clothing can be captured, the inner tab further comprising a cornered rib disposed on an opposite face of the inner tab relative to each cornered rib of the outer tab, whereby the cornered ribs on the opposite faces of the outer and inner tabs comprise opposite ribs operable to capture an article of clothing positioned in the space defined between the outer and inner tabs; and at least one lateral tab disposed within the space defined between the inner tab and the outer tab, wherein each lateral tab comprises a top edge operable to capture the same or another article of clothing captured in the space defined between the outer and inner tabs, wherein the top edge is situated above the at least one cornered rib of the outer tab, and wherein the top edge of the lateral tab is a horizontal surface substantially perpendicular to a vertical axis of the inner tab.

11. The hanger of claim 10, wherein each of the at least one lateral tab is situated entirely above the at least one cornered rib of the outer tab, and wherein no lateral tab is situated below the at least one cornered rib of the outer tab.

12. The hanger of claim 10, wherein the at least one lateral tab comprises a rectangular, polygonal, or trapezoidal geometry, and wherein the top edge of the lateral tab is situated above the cornered rib of the inner tab.

13. The hanger of claim 10, wherein the cornered rib of the inner tab comprises an oval or semi-circular profile with at least one rugged corner, and wherein at least one cornered rib of the outer tab comprises an uppercase "L"-like shape.

14. The hanger of claim 10, wherein the hanger does not include any auxiliary panel or extension panel, and wherein the securing panel comprises two lateral tabs disposed along opposing sections of the inner perimeter of the outer tab of the securing panel.

15. The hanger of claim 10, wherein the securing panel comprises a pair of two lateral tabs, and wherein each pair of two lateral tabs are disposed along opposing sections of the inner perimeter of the outer tab of the securing panel.

16. The hanger of claim 10, wherein the hanger further comprises an auxiliary section disposed downward from the body, the auxiliary section comprising:

an extension panel disposed downward from the body;

an auxiliary panel disposed downward from the extension panel; and at least one auxiliary securing panel disposed on the auxiliary panel, the auxiliary securing panel comprising:

an auxiliary outer tab connected to the auxiliary panel at two points;

at least one auxiliary inner tab connected to the auxiliary panel between the two points; and at least one auxiliary lateral tab disposed along an inner perimeter of the auxiliary outer tab.

17. The hanger of claim 16, wherein the neck comprises a base and a tab disposed on the base, and wherein the base comprises a substantially triangular geometry.

18. The hanger of claim 16, wherein the hanger includes one and only one neck.

19. The hanger of claim 16, wherein the hanger comprises two auxiliary lateral tabs disposed along opposing sections of the inner perimeter of the outer tab of the auxiliary securing panel, and wherein the inner perimeter of the auxiliary outer tab comprises two flat, opposingly disposed sections running parallel to a vertical axis of the hanger.

20. The hanger of claim 16, wherein the auxiliary securing panel comprises a pair of two auxiliary lateral tabs, and wherein each pair of two auxiliary lateral tabs are disposed along opposing sections of the inner perimeter of the outer tab of the auxiliary securing panel.

21. A hanger comprising:

a body comprising two arms disposed opposite to each other;

a neck disposed upward from the body; and a plurality of securing panels disposed downward from the body, each of the plurality of securing panels comprising:

an outer tab connected to the body at two points, the outer tab comprising a front face and a back face and having at least one cornered rib disposed on one of the front face and the back face of the outer tab, the at least one cornered rib comprising a first wall extending in a first direction intersecting a second wall extending in a second direction, both the first wall and the second wall being disposed on one of the front face and the back face of the outer tab;

an inner tab connected to the body between the two points, the inner tab being substantially in the same vertical plane as the outer tab, the inner tab comprising a front face facing the same direction as the front face of the outer tab and a back face facing the same direction as the back face of the outer tab, the inner tab being dimensioned as to define a space between an inner perimeter of the outer tab and an outer perimeter of the inner tab in which at least one article of clothing can be captured, the inner tab further comprising a cornered rib disposed on an opposite face of the inner tab relative to each cornered rib of the outer tab, whereby the cornered ribs on the opposite faces of the outer and inner tabs comprise opposite ribs operable to capture an article of clothing positioned in the space between the outer and inner tabs; and at least one lateral tab disposed within the space defined between the inner tab and the outer tab, wherein each lateral tab comprises a top edge operable to capture the same or another article of clothing captured in the space defined between the outer and inner tabs, and wherein the top edge is a horizontal surface substantially perpendicular to a vertical axis of the inner tab.

* * * * *